United States Patent [19]

Andersen

[11] 3,969,865

[45] July 20, 1976

[54] CEILING STRUCTURE

[75] Inventor: Finn Andersen, Greve Strand, Denmark

[73] Assignees: Finn Andersen; Keld Andersen, both of Denmark

[22] Filed: Aug. 26, 1974

[21] Appl. No.: 500,549

[30] Foreign Application Priority Data

Aug. 29, 1973 Denmark ..... 4746/73

[52] U.S. Cl. ..... 52/483; 52/489; 52/496; 52/760

[51] Int. Cl.[2] ..... E04B 5/52

[58] Field of Search ..... 52/484, 489, 496, 501, 52/502, 22

[56] References Cited

UNITED STATES PATENTS

| | | | |
|---|---|---|---|
| 1,997,580 | 4/1935 | Gibson et al. | 52/489 |
| 1,997,939 | 4/1935 | Loucks | 52/483 |
| 2,013,762 | 9/1935 | Olsen | 52/484 |
| 2,447,694 | 8/1948 | Finch | 52/489 |
| 2,753,440 | 7/1956 | Wakefield | 52/484 |
| 2,926,742 | 3/1960 | Fischer | 52/489 |
| 3,058,172 | 10/1962 | Phillips | 52/496 |
| 3,513,613 | 5/1970 | Jones | 52/496 |
| 3,708,941 | 1/1973 | Cuckson | 52/496 |

FOREIGN PATENTS OR APPLICATIONS

| | | | |
|---|---|---|---|
| 656,748 | 1965 | Belgium | 52/495 |
| 629,843 | 1949 | United Kingdom | 52/468 |

*Primary Examiner*—Ernest R. Purser
*Assistant Examiner*—William Randolph
*Attorney, Agent, or Firm*—Bucknam and Archer

[57] ABSTRACT

A ceiling structure having a plurality of ceiling sheets supported by a plurality of main beams and transverse suspension beams, the main beams on their upper part having resilient side webs to engage projections extending from the suspension beams, the main beams on their lower side having resilient web portions to secure some short beam-shaped suspension means, these suspension means having at their lower parts protruding suspension portions to engage grooves in adjoining ceiling sheets. This structure is easy to mount and permits a completely symmetrical pressure on the main beams during the mounting of each sheet.

2 Claims, 17 Drawing Figures

CEILING STRUCTURE

Figure 1:
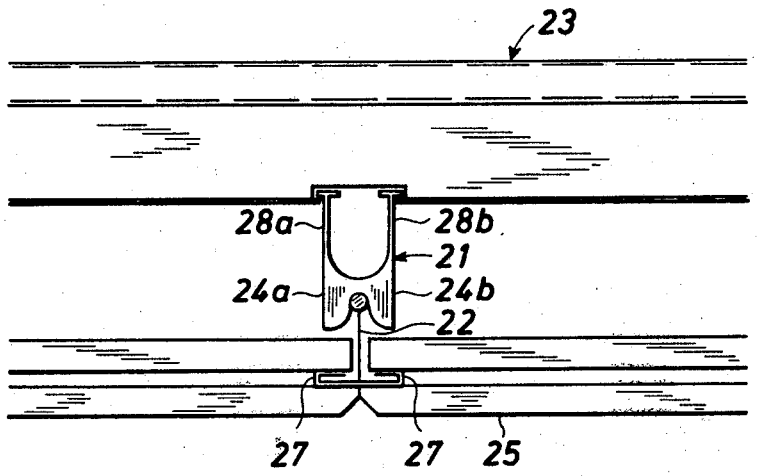

The invention relates to a ceiling structure of the type comprising a number of adjoining ceiling sheets, each sheet having two parallel grooves, the sheets further being supported by a number of main beams secured to a number of transverse suspension beams, said suspension beams being secured to a floor or to a roof structure.

From U.S. Pat. No. 2,066,205 is known a ceiling structure of the above-mentioned type, in which the ceiling sheets are secured to the main beams by means of a number of suspension means in the form of short T-shaped beams. Said beams are provided with free, resilient side portions being adapted to spring over and interlock with a longitudinal thickening on the main beam. This has the drawback that the suspension means must be made of spring steel to work satisfactorily, and that it will be very difficult to push the clamped suspension means in longitudinal direction in order to demount a single ceiling sheet.

The object of the present invention is to provide a ceiling structure permitting a single sheet of a roof comprising several sheets to be taken down easily and permitting a completely symmetrical pressure on the main beams during the mounting of each sheet.

The ceiling structure according to the invention is characterised in that the main beams on their upper parts are provided with free, resilient side webs, which when manually pressed towards each other are able to engage projections extending from the suspension beams, or lugs flushing with the under side of the suspension beams, said lugs being provided by punching a part of the sheet material of the suspension beams, and in that each main beam at its lower part has resilient web portions facing each other and being adapted to co-operate with and to secure some relatively short, preferable beam-shaped suspension means, said suspension means further being made in such a way that their upper parts can be squeezed in between the web portions of the main beam and be secured in this position by the pressure of said web portions, and in that the supporting means at their lower parts have protruding suspension portions which can engage grooves in adjoining sheets. As a result each sheet can easily be taken down, as the beam-shaped suspension means can easily be pushed in the longitudinal direction of the main beam towards the ceiling sheet, situated in prolongation of the first sheet in such a way that the sheet to be removed is released. It is only necessary to insert a thin blade of a knife between the sheets and to press the knife against the suspension means. Thus the main beams are exposed to completely symmetrical pressure, when the supporting means are pressed into said main beams, because the pressing in takes place in the symmetry plane; by this the individual main beam is prevented from turning over.

The ceiling structure according to the invention can further be characterised in that the beams and/or the suspension means are made by a "sendzimir"-galvanized iron sheet being bent. This reduces the price of the ceiling structure.

According to the invention the profile of the suspension means can have the shape of an inverted T the upper part of which is thickened, so that this part can be secured between the resilient web portions of the main beam. This design of the suspension means is especially simple and reliable.

Further, according to the invention the outwardly projecting suspension portions of the suspension means may comprise resilient bend portions, said bend portions being adapted to push the ceiling sheet upwards — when the suspension portions are in engagement with grooves. As a result the ceiling sheet is pressed into engagement between the suspension portion and the main beam.

Still, according to the invention the thickening of the upper part may increase linearly upwards, so that the suspension means can be secured in a position depending on the thickness of the ceiling sheet, when the sheet is mounted. As a result one suspension means can be employed for various sheet thicknesses.

Further, according to the invention the suspension portions of the suspension means may extend from a plane substantially perpendicular to the vertical plane in which the thickening is placed. This permits elongated, narrow ceiling sheets to be mounted without being deformed during the mounting. Due to design of the suspension means the pressure on the main beams is symmetrical. The fact that the suspension portions extend substantially at right angles to the horizontal plane, in which the thickening is placed, has the effect that the longitudinal direction of the ceiling sheets will be perpendicular to the longitudinal direction of the main beams. Thus it will not be absolutely necessary to mount the main beams very close to each other.

Still, according to the invention special auxiliary beams may be provided for mounting sheets of fragile material, such as gypsum, said auxiliary beams having grooves to engage the suspension portions and bent portions which prior to the mounting of the sheets can be inserted into relatively narrow and short grooves in the sheet at a relatively long distance from the upper surface. Hereby the range of material types, among which the sheet material can be chosen, is widened, as it is now possible also to use a relatively fragile material. This is due to the fact that the pressure of the suspension means is distributed over the entire sheet edge and that the pressure is transmitted in such a way that the sheet will have the greatest possible compressive strength.

Furthermore, according to the invention a furnishing can be provided for securing a main beam to a roof structure in the form of a horizontal rafter, said furnishing having a horizontal securing surface to be secured to the under side of the rafter and parallel descending and alternately placed engaging means with a number of notches adapted to engage with the free, resilient side webs of the main beams.

The suspension means according to the invention may furthermore comprise a relatively small, preferable rectangular sheet having punched lug pieces and upwardly extending thin lugs being provided with thickenings at their ends. Thus, a suspension means for mounting the ceiling elements transverse to the main beams is provided, the manufacture of said suspension means being inexpensive.

Further, the invention relates to a method for the production of a ceiling structure according to the invention. This method is characterised in that a first set of suspension means is pressed into one beam to mount the first ceiling sheet, whereafter one suspension portion of each suspension means is inserted into a groove at one sheet edge, and that a second set of suspension means is then inserted into the groove in the opposite sheet edge, and that the latter suspension means are then pressed into a second main beam, the distance between the main beams being according to the width of the ceiling sheets, whereafter the remaining ceiling sheets in the same row which extends in the longitudinal direction of the main beams are mounted in the same manner as the first ceiling sheet, and that the ceiling sheets in the remaining rows are mounted by means of the free suspension portions of the suspension means already mounted. This permits a particularly simple method for the production of a ceiling structure.

Figure 2:
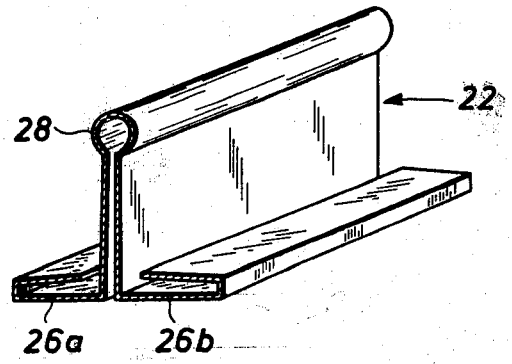
Figure 3:
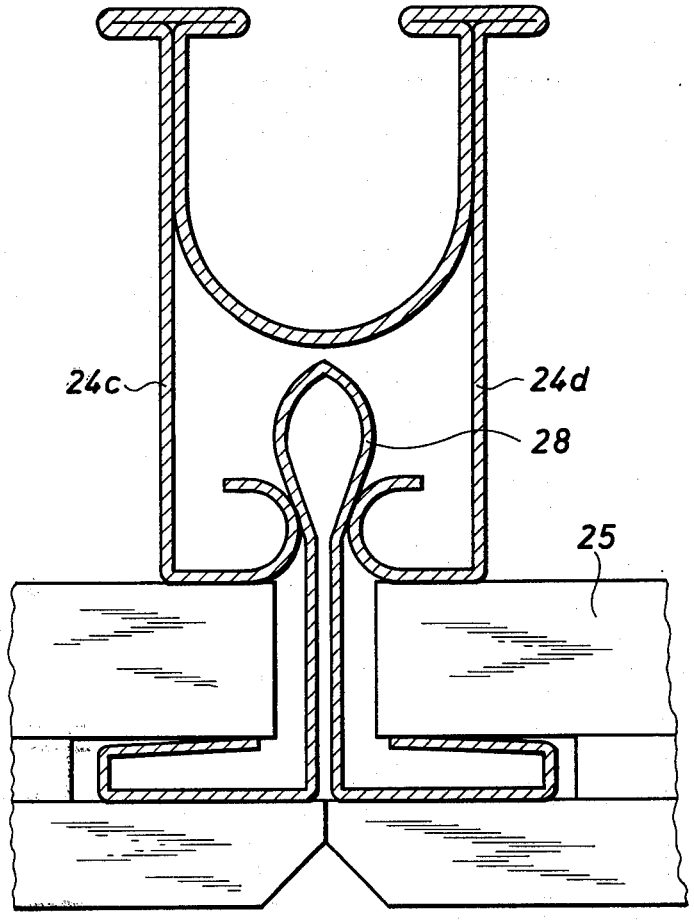
Figure 4:
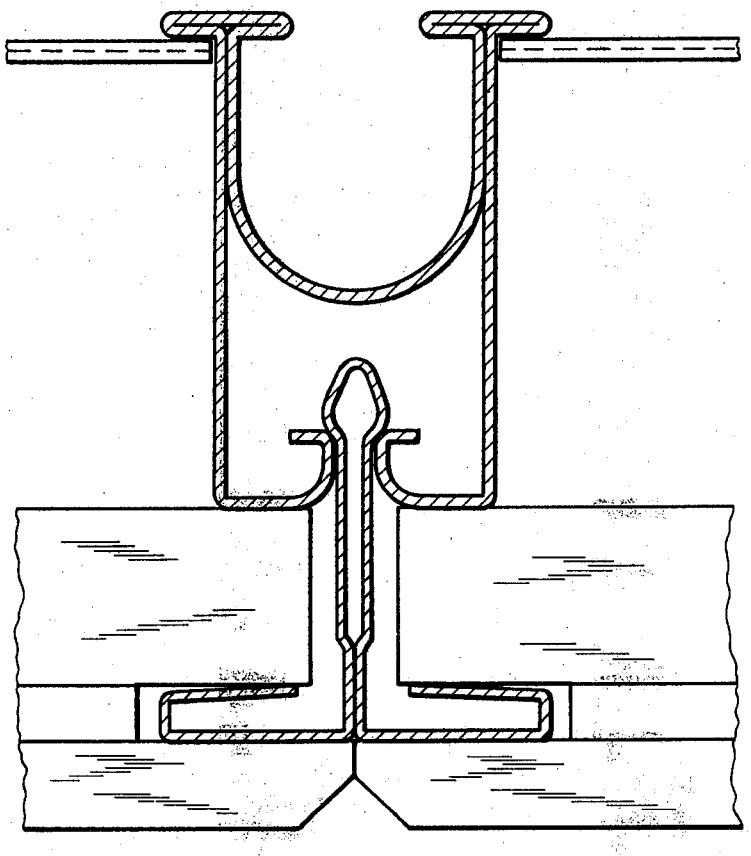
Figure 5:
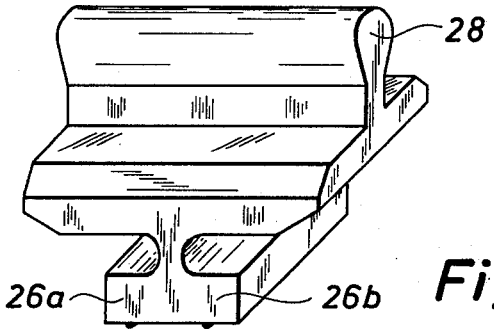
Figure 6:
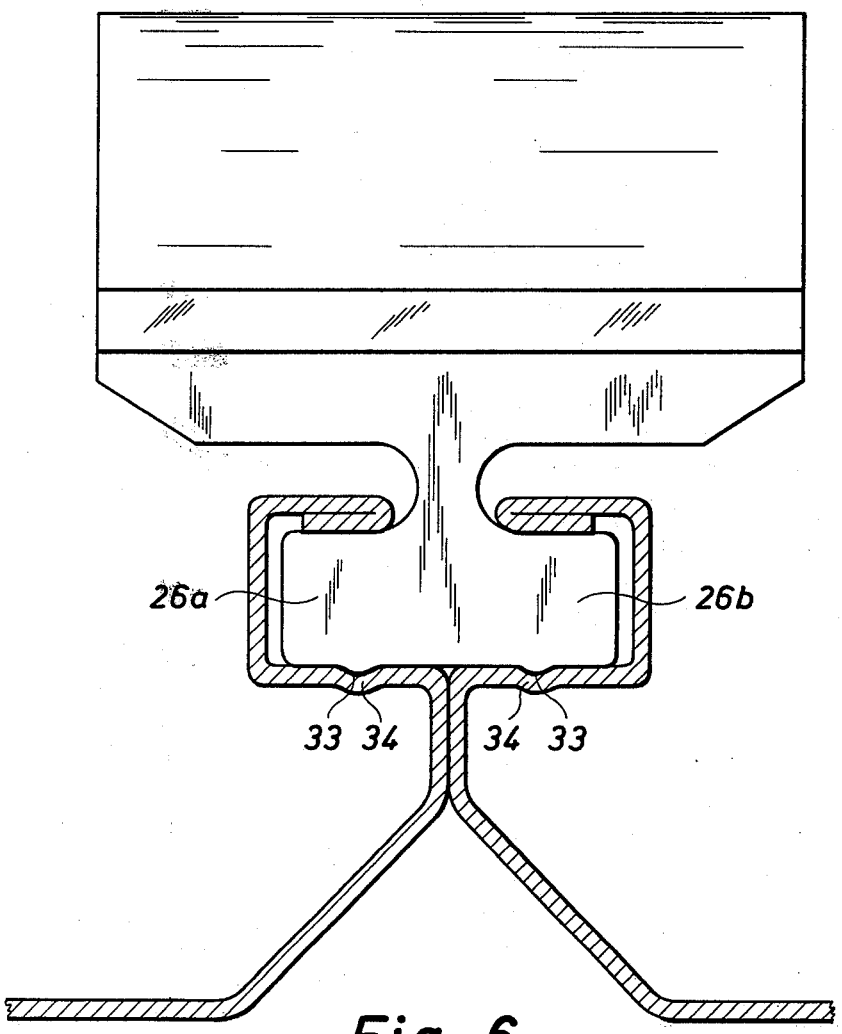
Figure 7:
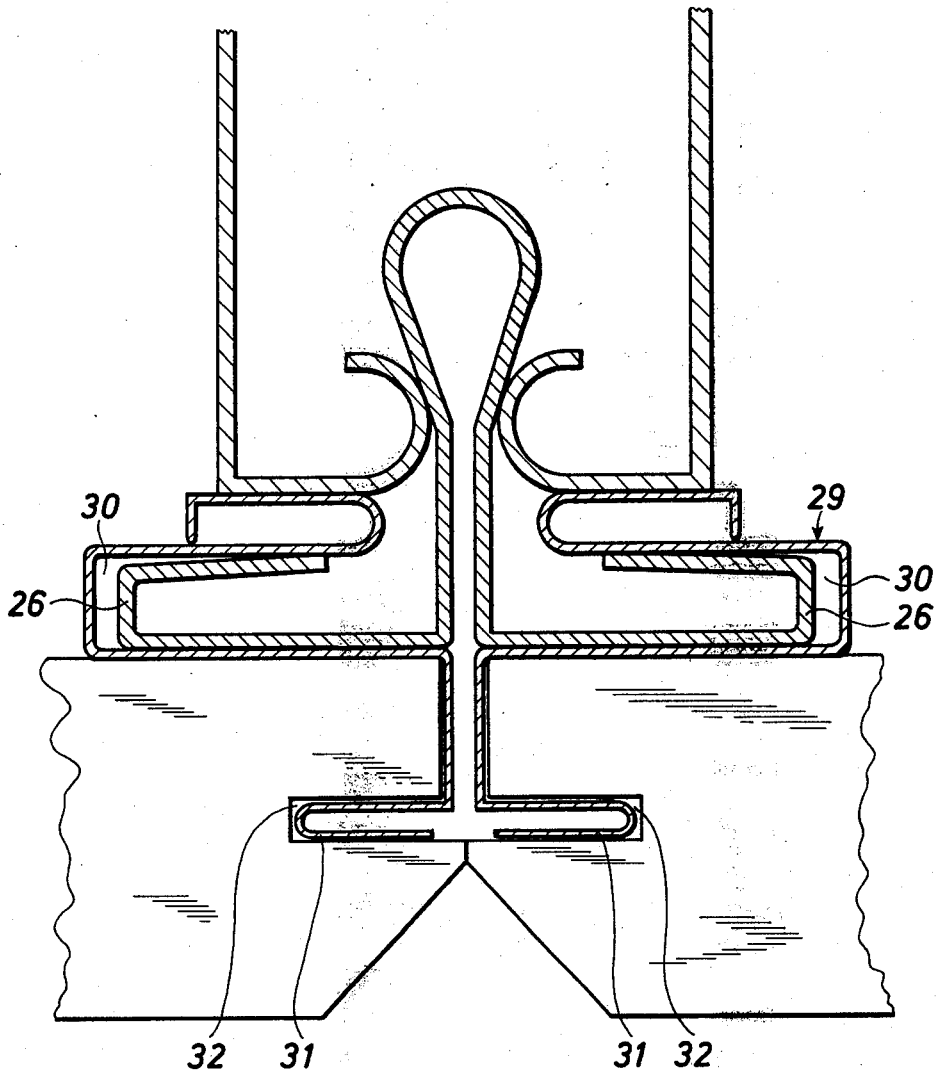
Figure 8:
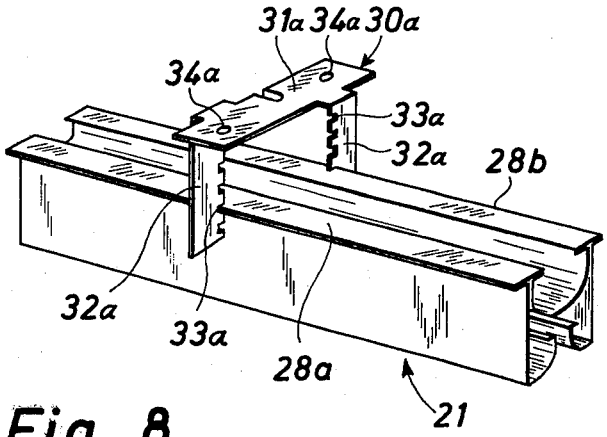
Figure 9:
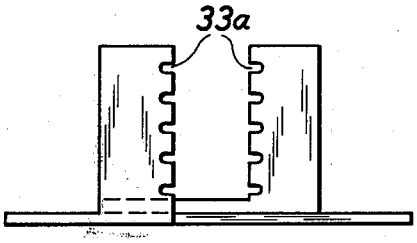
Figure 10:
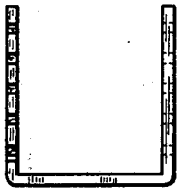
Figure 11:
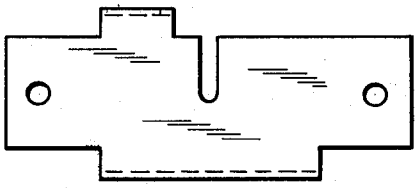
Figure 12:
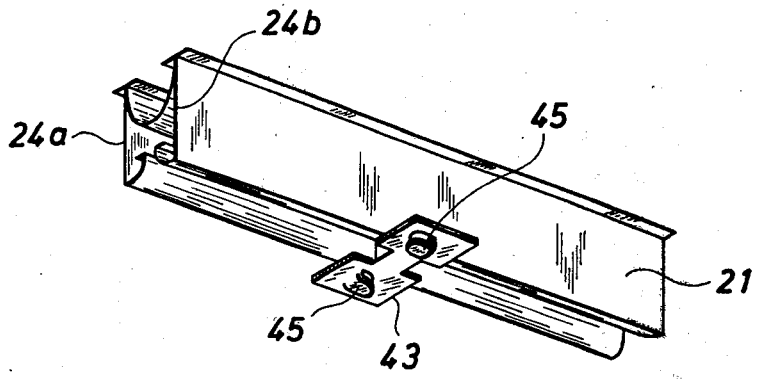
Figure 13:
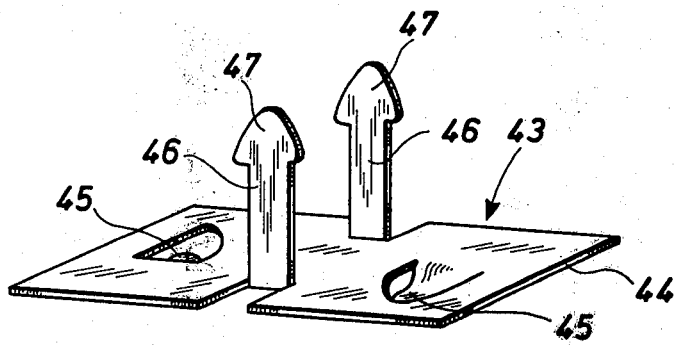
Figure 14:
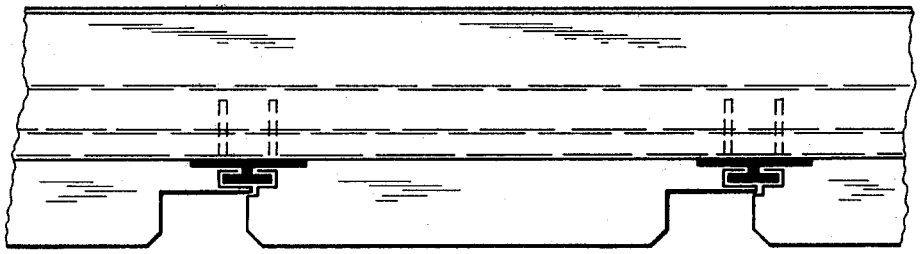
Figure 15:
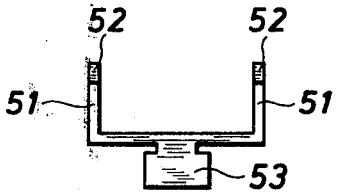
Figure 16:
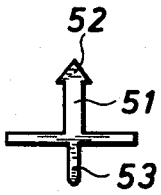
Figure 17:
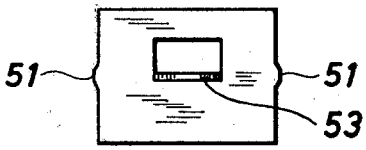

The invention will be described below with reference to the accompanying drawings, in which:

FIG. 1 schematically shows the ceiling structure according to the invention, illustrating a sectional view of a main beam in which a suspension means suspending two ceiling sheets is provided, FIG. 2 is a perspective view of the suspension means, FIG. 3 is a detail sectional view of the structure shown in FIG. 1 showing a suspension means pressed into the main beam and suspending some ceiling sheets, FIG. 4 is a sectional view similar to FIG. 3 and showing second embodiment of the suspension means and the main beam, FIG. 5 is a perspective view showing a third embodiment of the suspension means, FIG. 6 is a detail view, partly in section, of the suspension means shown in FIG. 5 to which a ceiling element forming the ceiling surface is secured, FIG. 7 is a detail sectional view illustrating an auxiliary beam for mounting sheets of fragile material, FIG. 8 is a perspective view of a furnishing which can be secured to the under side of a horizontal rafter, FIG. 9 is a side elevational view of the furnishing, shown in FIG. 8, FIG. 10 is an elevation view of the furnishing, shown in FIG. 8, but taken at right angles to the view of FIG. 9, FIG. 11 is a top plan view of the furnishing, shown in FIG. 8, FIG. 12 is a perspective view showing another embodiment of the suspension means shown in FIG. 5, FIG. 13 is a perspective view that shows the upwardly extending lugs of the suspension means which can be squeezed in between the resilient side webs of the main beam, FIG. 14 is an elevation view of a ceiling structure according to the invention and giving example of the design and mounting of the respective ceiling sheets, FIG. 15 is a side elevational view of a means for securing a main beam to a transverse suspension beam, FIG. 16 is a front view of the securing means, and FIG. 17 is the securing means seen from below.

The ceiling structure shown in FIG. 1 is by means of furnishings not shown secured to a rafter likewise not shown. Each furnishing ends in a cruciform portion, on which a suspension beam 23 is mounted. Said suspension beam 23 has two side webs, on which two longitudinal, opposed bendings for receiving the transverse arm of the cruciform end portion are provided. Main beams 21 are placed at right angles to the suspension beam 23 and at the under side thereof. Each suspension beam is at its under side provided with resilient web portions 24*a* and 24*b* facing each other as in FIG. 1, or 24*c* and 24*d* as in FIG. 3, and adapted to co-operate with and to secure some relatively short beams 22, serving as suspension means 22 for the ceiling sheets 25 — cf. FIGS. 3 and 4. The suspension means 22 are designed in such a manner that their individual upper parts can be squeezed in between the resilient web portions 24*a* and 24*b* of the main beams 21 and be secured in that position by the pressure of said web portions 24*a*, 24*b*. On the lowest parts of the suspension means 22 suspension portions 26*a*, 26*b* have been provided — see FIG. 2 — said portions being adapted to engage grooves 27 in adjoining sheets 25 and substantially filling out said grooves at the same time as being kept in press therein.

The profile of the suspension means 22 can advantageously be shaped as an inverted T — see FIG. 2 — where the transverse arm of the inverted T forms the suspension portions 26*a*, 26*b* protruding in opposite directions.

The upper part 28 of the suspension means 22 is thickened to such an extent that said upper part 28 can be secured between the web portions 24*a*, 24*b* of the main beam 21. In an especially preferred embodiment — see FIG. 3 — the thickening 28 increases linearly upwards. Thus one suspension means 22 can be used for several thicknesses of sheet, because the resilient web portions 24*a*, 24*b* of the main beam will be able to secure the suspension means 22 at an arbitrary level, the only provision being that the end portions of the web portions 24*a*, 24*b* touch the upwardly increasing thickening. Due to said thickening the suspension means 22 will always cause an upwardly directed pressure, which via the suspension portions 26*a*, 26*b* will act on the sheets 25 after mounting of a sheet 25 — if the sheet is thick enough. At the same time the suspension portions 26*a*, 26*b* will yield a little due to resilience and dimensions, so that the suspension portions 26*a*, 26*b* engaging the grooves 27 will push the sheet 25 upwards. The sheet will then be pressed between the main beam 21 and the suspension portions 26*a*, 26*b* and will thereby be prevented from rattling.

In a third embodiment of the suspension means 22 — see FIG. 5 — the suspension portions 26*a*, 26*b* extend from a plane perpendicular to the vertical plane in which the thickening 28 is placed. Such a suspension means 22 is first and foremost adapted for mounting the sort of long, narrow ceiling elements of aluminium being used in soundproof rooms. These ceiling elements are substantially hollow — see FIG. 6 — and are provided with holes on the surface, whereas at their inner side they are provided with a sound absorbing material. Along the sides they are provided with bendings, which can be led in over the suspension portions 26*a*, 26*b* during the mounting. By using this suspension means it is possible to mount long, narrow ceiling elements transverse to the main beams 21. Hereby the use of an excessive amount of main beams is avoided, because such main beams by means of the first-mentioned suspension means should be arranged on the suspension beams 23 at a distance corresponding to the width of one of the narrow ceiling elements. To interlock the ceiling elements small elevations 33 may be provided on the under side of the suspension means 22, said elevations 33 being adapted to engage notches 34 in the bendings of the ceiling element. Other means for interlocking the ceiling elements may also be used.

In most cases it is desirable to use ceiling sheets 25 of gypsum. Such sheets cannot, however, be mounted on the main beams by means of suspension means only. A large number of the sheets 25 would break either during or after the mounting because of the poor compressive strength of gypsum. This is due to the fact that during and after mounting the individual sheet is exposed to pressures. In order to solve these problems there are, according to the invention, provided auxiliary beams — see FIG. 7 — said auxiliary beams having grooves 30 to be engaged by the suspension portion 26 and bendings 31, which prior to the mounting of the sheets can be inserted into narrow grooves 32 along the edges of the sheet. These narrow grooves 32 are relatively short and narrow and are provided at a relatively long distance from the up-turned surface of the sheet.

However, these auxiliary beams only extend in the longitudinal directions of the ceiling sheets 25. Consequently, the joints of the sheets in this direction will be substantially air tight, as there will be access only to the closed interior of the main beams 21 via small, thin slits between the sheets 25. In order to obtain the same tightness at the sheet joints in the transverse direction one end portion of the sheet 25 is provided with a transverse projection, which can overlap the other end portion of an adjoining sheet 25.

Further, the ceiling sheets may be mineral wool sheets, such as "carlite sheets", chip plates or sheet cassettes.

The manufacture of the ceiling structure is simple. First, the two suspension beams 23 are secured to a floor or a roof construction and are levelled. Then two transverse main beams 21 are placed at the under side of the suspension beams 23, said beams being placed with a long distance between them, and thus they form a frame. This placing is effected by causing the resilient side webs 28*a*, 28*b* of the main beams 21 when manually pressed together to engage lugs of suspension beams, which lugs have been provided by punching a part of the sheet material of the suspension beams 23. The frame is then levelled, whereafter the remaining main beams 21 are secured to the suspension beams 23. The distance between the main beams 21 will then correspond to the width of a ceiling sheet 25. Then the only thing remaining is to fasten each ceiling sheet 25. This may for example be done be first inserting the suspension portions 26*a*, 2j6*b* of a set suspension means 22 into a groove 27 of a sheet edge or into the groove 30 of a mounted auxiliary beam and then pressing the thickenings 28 of the suspension means 22 up between the web portions 24*a*, 24*b* of a main beam 21 and then inserting the suspension portions 26*a*, 26*b* of a second set of suspension means 22 into the groove 27 or groove 30 in the adjacent sheet edge and finally squeezing the latter set of suspension means 22 up into an adjacent main beam 21. If the ceiling sheets 25 are not quite stiff or if they are relatively long, it is possible when mounting the first sheet as an alternative to begin at the centre of the sheet and to insert a single suspension means 22 in the groove 27 or the groove 30 at each side edge and to press the suspension means up into two main beams 21. As the end portions of the sheet 25 incline a little from the main beams 21 it is now possible to insert the remaining suspension means and to press them up between the web portions.

The ceiling structure having sound-absorbing material shown in FIG. 6 may be mounted in substantially the same manner; however, the sheets 25 are to be mounted transverse to the main beams 21.

The mounting of the ceiling structure according to the invention is very simple. It is for example not necessary to worry about the necessary accuracy when measuring out the distance between the main beams 21, said distance being provided in the suspension beams 23 by the suspension beam lugs. Further, the symmetrical pressure on the main beams 21 during mounting of sheets has the effect that the sheets are not deformed unsymmetrically. Such deformation would be visible.

A ceiling structure suitable for non-professional housebuilders is thus provided.

The ceiling structure will, however, also be suitable for professional artisans, because it can be quickly mounted.

The ceiling structure according to the invention can be used advantageously also for institution buildings. However, in connection with said institutional buildings it has been difficult to obtain the approval from the fire-service. These problems have, however, been solved by means of the furnishing 30*a* shown in FIG. 8. The furnishing is adapted to be secured to a horizontal rafter, and the furnishing is provided with a horizontal securing surface 31*a* to be fastened to the under side of the rafter. At the edges of the plate 31*a* the furnishing 30*a* is provided with descending, parallel and alternately placed engaging means 32*a* having a number of notches 33*a*. The free resilient side webs 28*a*, 28*b* of a main beam 21 may engage said notches. The furnishing 30*a* may be mounted advantageously in such a way that it is first mounted longitudinally with respect to the suspension beam (which is identical with the main beam), said suspension beam having downwards facing engaging means 32*a*. Then the furnishing 30*a* is manually turned 90° thus causing the notches 33*a* of the engaging means 32*a* to be led in over the side webs 28*a*, *28b* of the beam 21. As the engaging means 32*a* may be provided with many notches 33*a* — FIG. 9 — it is possible to adjust the level of the suspension beam 21. Then the furnishing 30*a* can be secured to the under side of the rafter by means of screws or nails, which are led through the holes 34*a* provided in the securing surface 31*a*. The advantageous feature of this furnishing 30*a* is that it need not be led up through the radiation reflecting layer situated below the rafters and below the ceiling insulation between the rafters. Improved safety is thus obtained in case the ceiling sheets catch fire, because the radiation reflecting layer will for quite some time prevent the roof insulation from falling down. This has proved to be of importance in connection with institution buildings.

A further development of the another suspension means shown in FIG. 5 is shown in FIG. 12. Also this suspension means 43 is adapted to mount the ceiling elements transverse to the main beams 21. Said suspension means comprise a relatively small rectangular sheet 44 having downwards turned lug pieces 45. Further, two projecting thin lugs having thickenings 47 at their ends extend from the sheet 44. The lug pieces 45 are designed to suspend the ceiling elements — see FIG. 12 — whereas the thin lugs 46 with thickenings 47 are designed to be secured between the resilient web portions 24*a*, 24*b* of a main beam 21. An advantage of these suspension means is that one set of beams 21 is sufficient, and that said beams need not be provided with punched lug pieces or punchings. When using these suspension means one will to a great extent have a free hand as regards the choice of the width of the roof elements to be used, because one no longer has to depend on pre-punched lug pieces or punchings. The supporting means may be made of a few punchings and a few bendings of a thin, relatively small sheet. In this connection no great accuracy is required. Consequently, the suspension means will be inexpensive to manufacture.

To secure the main beams to the suspension beams special securing means — see FIGS. 15, 16 and 17 — may be used. These securing means comprise relatively small, rectangular sheets provided with upwardly projecting thin lugs 51 having thickenings 52 at their ends. These thickenings may be secured between the resilient web portions 24*a*, 24*b* of a main beam (suspension beam). Further, each sheet has a downwards turned lug 53 adapted to be kept in press between the resilient side webs 28*a*, 28*b* of a second main beam 21. The advantage obtained by using these securing means is that as a result of the independency as to punchings in the suspension beams one has a free hand as to the width of the ceiling elements. The ceiling structure according to the invention and especially the profile of the main beam 21 may be modified in many ways without deviating from the idea of the invention.

What is claimed is:

1. A ceiling structure of the type having a plurality of adjoining ceiling sheets having two mutually parallel grooves, said ceiling sheet being supported by suspension means shaped as in inverted T, the lower part of the suspension means being provided with protruding suspension portions, and the upper part of said suspension means being thickened, said suspension means being secured to a plurality of main beams being symmetrical with regard to a longitudinal central plane and at their lower parts being provided with resiliently movable end webs facing each other and their upper parts engaging parts of transverse suspension beams, characterized by each of the main beams having two side webs mutually connected by means of a resilient intermediate web which is U-shaped and having legs of lengths permitting the upper portions of the side webs to be displaced with respect to each other, said upper portion having flanges received by the suspension beams, said lower part of the main beams being provided with mutually facing end webs disposed in a plane perpendicular to said centre plane.

2. A ceiling struture according to claim 1 further characterized by a plurality of auxiliary beams for mounting ceiling sheets of fragile material, said auxiliary beams having grooves disposed to engage said protruding suspension portion.

* * * * *